US008337641B2

(12) United States Patent
Yamamoto et al.

(10) Patent No.: US 8,337,641 B2
(45) Date of Patent: Dec. 25, 2012

(54) TREATMENT SOLUTION FOR FORMING BLACK HEXAVALENT CHROMIUM-FREE CHEMICAL CONVERSION COATING FILM ON ZINC OR ZINC ALLOY

(75) Inventors: Tomitaka Yamamoto, Tokyo (JP); Naoki Okabe, Tokyo (JP)

(73) Assignee: Dipsol Chemicals Co., Ltd., Tokyo (JP)

( * ) Notice: Subject to any disclaimer, the term of this patent is extended or adjusted under 35 U.S.C. 154(b) by 0 days.

(21) Appl. No.: 12/062,856

(22) Filed: Apr. 4, 2008

(65) Prior Publication Data

US 2008/0210341 A1 Sep. 4, 2008

Related U.S. Application Data

(63) Continuation of application No. PCT/JP2006/320083, filed on Oct. 6, 2006.

(30) Foreign Application Priority Data

Oct. 7, 2005 (JP) ..... 2005-295473

(51) Int. Cl.

| | |
|---|---|
| ***C23C 22/24*** | (2006.01) |
| ***C23C 30/00*** | (2006.01) |
| ***C23C 22/00*** | (2006.01) |
| ***C22C 28/00*** | (2006.01) |

(52) U.S. Cl. ..... 148/267; 148/22; 148/400; 148/252

(58) Field of Classification Search ..... None
See application file for complete search history.

(56) References Cited

U.S. PATENT DOCUMENTS

| | | | | |
|---|---|---|---|---|
| 4,349,392 | A * | 9/1982 | Huvar | 148/266 |
| 4,801,337 | A | 1/1989 | Higgins | |
| 2003/0148122 | A1 * | 8/2003 | Oshima et al. | 428/472 |
| 2004/0156999 | A1 * | 8/2004 | Biddulph et al. | 427/436 |
| 2006/0237098 | A1 * | 10/2006 | Matzdorf et al. | 148/247 |

FOREIGN PATENT DOCUMENTS

| | | | |
|---|---|---|---|
| JP | 63-270481 | A | 11/1988 |
| JP | 2000054157 | | 2/2000 |
| JP | 2000509434 | | 7/2000 |
| JP | 2003268562 | | 9/2003 |
| JP | 2005-206872 | A | 8/2005 |
| JP | 2005206872 | | 8/2005 |
| KR | 1996-0007773 | B1 | 6/1996 |

OTHER PUBLICATIONS

Office Action issued in Japanese Patent Application No. 2005-295478, dated Feb. 13, 2012.

* cited by examiner

*Primary Examiner* — Emily Le
*Assistant Examiner* — Sarah A Slifka
(74) *Attorney, Agent, or Firm* — Hoffmann & Baron, LLP

(57) ABSTRACT

Disclosed is a treatment solution for use in the formation of a black trivalent chromium chemical conversion coating film with uniformly stabilized black wash, luster and corrosive resistance irrespective of the type of the acidic, neutral or alkaline zinc plating bath employed or the presence or absence of nickel eutectoid. Also disclosed is a method of forming the black trivalent chromium chemical conversion coating film. The treatment solution comprises a trivalent chromium ion, a chelating agent capable of forming a water-soluble complex with the trivalent chromium, at least one metal ion selected from the group consisting of a cobalt ion, a nickel ion and an iron ion, and formic acid or a salt thereof as a buffer for hydrogen ion concentration. The treatment solution can be used for forming a black hexavalent chromium-free chemical conversion coating film on zinc or a zinc alloy.

7 Claims, No Drawings

TREATMENT SOLUTION FOR FORMING BLACK HEXAVALENT CHROMIUM-FREE CHEMICAL CONVERSION COATING FILM ON ZINC OR ZINC ALLOY

CROSS REFERENCE TO RELATED APPLICATIONS

This application is a continuation of international application PCT/JP2006/320083, filed Oct. 6, 2006, which claims priority to JP2005-295473, filed Oct. 7, 2005, the entire content of each of which is incorporated by reference.

FIELD OF INVENTION

The present invention relates to a treatment solution and method for forming a black trivalent chromium chemical conversion coating film which has a uniform and stable black and burnished appearance and corrosion resistance, regardless of a type of zinc plating bath, such as acidic, neutral and alkaline or nickel eutectoid.

BACKGROUND ART

Zinc or zinc-nickel alloy plating on an iron and steel material protects iron due to a self-sacrifice anti-corrosion effect and thus has been widely applied as a method for inhibiting corrosion of iron and steel. However, only zinc or zinc-nickel alloy is not enough in terms of corrosion resistance and thus a chromic acid treatment, so called chromate treatment, oil zinc or zinc-nickel alloy plating has been widely applied in industry. On the other hand, recently, hexavalent chromium is eluted from abandoned vehicles and home electric appliances due to acid rain and thus it is pointed out that it harms human bodies because the eluted hexavalent chromium contaminates soil and groundwater and thus affects ecosystems, and as a result, it is an urgent technical issue to provide alternatives to a hexavalent chromium coating film.

A corrosion resistance coating film in which trivalent chromium is used is proposed as one of said alternatives. For example, JP 2000-54157 A proposes a chemical conversion treatment in which trivalent chromium, phosphorus and a metal salt such as molybdenum are used. However, as a result of our confirmation test, it was found that a satisfactory black appearance and corrosion resistance could not be reproduced. In addition, JP 2000-509434 A proposes a chemical conversion treatment in which trivalent chromium, nitric acid, organic acid and a metal salt such as cobalt are contained. Since in this treatment a concentration of trivalent chromium is as high as the range of 5 to 100 g/l and the treatment is carried out at an elevated temperature, this treatment has the advantage that a good corrosion resistance can be obtained, but the disadvantage that a stable corrosion resistance cannot be obtained. In addition, since in the treatment solution, the content of trivalent chromium is high and the organic acid is used in a large amount, water disposal thereof is difficult and the amount of sludge produced after the treatment is large. This produces a large amount of waste and thus this treatment has the disadvantage that a substantial environment load is produced due to the waste. In addition, this treatment has a problem that the black and burnished appearance of the chemical conversion coating film changes significantly depending on the amount of nickel eutectoid. This treatment also has the problems that it is necessary to elevate a temperature of the treatment solution if the uniform black and burnished appearance and corrosion resistance are industrially obtained and the treatment solution has a narrower tolerance to pH and concentrations of constituents.

Patent Article 1: Japanese Un-Examined Patent Publication 2000-54157; and

Patent Article 2: Japanese Un-Examined Patent Publication 2000-509434.

SUMMARY OF THE INVENTION

It is an object of the present invention to provide a treatment solution and method for forming a black trivalent chromium chemical conversion coating film which has a uniform and stable black and burnished appearance and corrosion resistance, regardless of a type of zinc plating bath, such as acidic, neutral and alkaline or nickel eutectoid.

The present invention is based on a discovery that the above problems can be solved by using formic acid or a salt thereof as a buffer added into a solution for a black trivalent chromium chemical conversion treatment after zinc or zinc alloy plating formed from a type of plating bath such as acidic, neutral and alkaline. That is, the present invention provides a treatment solution for forming a black hexavalent chromium-free chemical conversion coating film or zinc or zinc alloy, the solution comprising:

a trivalent chromium ion;

a chelating agent capable of forming a water soluble complex with the trivalent chromium ion;

one or more metal ions selected from the group consisting of cobalt ion, nickel ion and iron ion; and formic acid or a salt thereof used as a buffer in a hydrogen-ion concentration.

The present invention also provides a method for chemical conversion treating, comprising the step of chemical conversion treating zinc or zinc alloy with the above treatment solution to form a black hexavalent chromium-free chemical conversion coating film on the zinc or zinc alloy wherein a temperature of the treatment solution is in the range of 10 to 50° C.

The present invention further provides a metal coated by zinc or zinc alloy and having a black hexavalent chromium-free chemical conversion coating film formed by chemical conversion treating with the above treatment solution on the zinc or zinc alloy.

DETAILED DESCRIPTION

According to the present invention, a black trivalent chromium chemical conversion coating film can be formed on a zinc or zinc alloy plating. Plating products to which the present method is applied have excellent corrosion resistance of a trivalent chromium coating film in addition to corrosion resistance of zinc or zinc alloy plating. In addition, the present invention produces a black trivalent chromium chemical conversion coating film which has a uniform and stable black and burnished appearance and corrosion resistance, regardless of a type of zinc plating bath, such as acidic, neutral and alkaline or nickel eutectoid and thus the present invention is expected to be widely applied to a variety of fields from now.

The substrate used in the present invention includes a variety of metals such as iron, nickel and copper, alloys thereof and metals or alloys such as aluminum, which have been subjected to zincate treatment in a variety of shapes such as plate-like, rectangular prism-like, column-like, cylindrical and spherical shapes.

The above substrate is plated with zinc or a zinc alloy according to the usual method. The zinc plating may be deposited on the substrate using either of an acidic/neutral bath such as a sulfuric acid bath, borofluoride bath, potassium chloride bath, sodium chloride bath and ammonium chloride-potassium chloride bath or an alkaline bath such as an alkaline cyanide bath, zincate bath and pyrophoric acid bath, but particularly, a cyanide bath is preferable. The zinc alloy plating may be an ammonium chloride bath or an alkaline bath such as organic chelate bath.

In addition, the zinc alloy plating includes a zinc-iron alloy plating, zinc-nickel alloy plating having a rate of nickel-co-deposition in the range of 5 to 20% by mass, zinc-cobalt alloy plating and tin-zinc alloy plating. A zinc-nickel alloy plating is preferable. The thickness of the zinc or zinc alloy plating to be deposited on a substrate may arbitrarily be selected, but 1 μm or more are preferable and 5 to 25 μm are more preferable.

In the present invention, after the zinc or zinc alloy plating is deposited on a substrate according to the above method or, in addition to said deposition, if necessary, the plated substrate is water rinsed and optionally activated by a nitric acid, the zinc or zinc alloy plating is subjected to a dipping treatment or the like using a treatment solution for forming a black hexavalent chromium-free chemical conversion coating film according to the present invention.

In the treatment solution of the present invention, any chromium compound containing trivalent chromium ion may be used as a source of the trivalent chromium ion, but it is preferred that a trivalent chromium salt such as chromium chloride, chromium sulfate, chromium nitrate, chromium phosphate and chromium acetate be used, or it is also possible to reduce hexavalent chromium ion of chromic acid, dichromic acid and the like into trivalent chromium ion using a reducing agent. The especially preferable source of trivalent chromium ion is chromium chloride. One of the above sources of trivalent chromium ion or any combination of at least two of them may be used. The concentration of trivalent chromium ion in the treatment solution is not limited from the viewpoint of its properties, but is preferably as low as possible from the viewpoint of the waste water treatment. Therefore, it is preferred that the concentration of trivalent chromium ion in the treatment solution be in the range of 0.5 to 15 g/L and more preferably 1 to 10 g/L, taking into account the corrosion resistance and the like. In the present invention, the use of trivalent chromium in such a low concentration is advantageous from the viewpoint of the waste water treatment and the cost.

The chelating agent capable of forming a water soluble complex with the trivalent chromium ion used in the treatment solution according to the present invention include a hydroxycarboxylic acid such as tartaric acid and malic acid, a monocarboxylic acid (except formic acid), a polyvalent carboxylic acid such as a dicarboxylic acid such as oxalic acid, malonic acid, succinic acid, citric acid and adipic acid, or a tricarboxylic acid, and an aminocarboxylic acid such as glysinic acid. In this connection, since formic acid does not easily form a water-soluble complex with the trivalent chromium ion and thus those skilled in the art do not use it as a chelating agent, it is not included in the "chelating agent capable of forming a water soluble complex with the trivalent chromium ion used in the treatment solution according to the present invention" or "monocarboxylic acid". As the chelating agent, one of these acids or salts thereof (e.g. salt of sodium, potassium, ammonium or the like) or any combination of at least two of them may also be used. The concentration of the chelating agent in the treatment solution is not limited, but preferably in the range of 1 to 40 g/L, and more preferably in the range of 5 to 35 g/L in total.

The molar ratio of the chelating agent to the trivalent chromium ion in the treatment solution according to the present invention (the chelating agent/trivalent chromium ion) is preferably in the range of 0.2/1 to 4/1, and more preferably in the range of 1/1 to 2/1.

The treatment solution according to the present invention contains one or more metal ions selected from the group consisting of cobalt ion, nickel ion and iron ion. As the sources of cobalt ion, nickel ion and iron ion, any metal compounds containing any of these metals can be used. One of such metal compounds or any combination of at least two of them may be used, but it is preferred that one or more salts of cobalt and one or more salts of nickel be used. The concentration of said metal ion in the treatment solution is not limited, but preferably in the range of 0.1 to 100 g/L, and more preferably in the range of 0.5 to 20 g/L, in terms of cation, in total.

The formic acid or salt thereof contained in the treatment solution according to the present invention as a buffer in a hydrogen-ion concentration is not limited. Specifically, sodium formate, potassium formate, ammonium formate and the like are used. In the present invention, one of the formic acids or salts thereof or any combination of at least two of them may be used. The concentration of the formic acid or salts thereof in the treatment solution is not limited, but preferably in the range of 0.1 to 100 g/L, and more preferably in the range of 1 to 20 g/L.

In addition, a good black appearance of the zinc or zinc alloy plating can be obtained by adding one or more inorganic acid ions selected from the group consisting of a phosphate ion, chlorine ion, nitrate ion and sulfate ion into the treatment solution according to the present invention. A source of the phosphate ion includes a phosphorus oxyacid such as phosphoric acid and phosphorous acid and salts thereof. A source of the chlorine ion includes hydrochloric acid and a hydrochloride salt such as sodium chloride and potassium chloride. A source of the sulfate ion includes sulfurous oxyacid such as sulfuric acid and sulfurous acid and salts thereof. A source of the nitrate ion includes nitric acid, nitrous acid etc. and salts thereof. In the treatment solution according to the present invention, one of the above acids or salts thereof or a mixture of two or more of them can also be used. The concentration of the inorganic acid ions in the treatment solution is not limited, but preferably in the range of 1 to 150 g/L, and more preferably in the range of 5 to 80 g/L.

The pH of the treatment solution according to the present invention is preferably 0.5 to 4, more preferably 1 to 3. The pH can be adjusted by using the above inorganic acid, an organic acid, an alkaline hydroxide, ammonia water or the like.

A black trivalent chromium chemical conversion coating film is formed on the zinc or zinc alloy plating through chemical conversion treating the zinc or zinc alloy plating by immersing it into the above treatment solution according to the present invention or the like. A temperature of the treatment solution is preferably in the range of 10 to 50° C. and more preferably in the range of 20 to 40° C. An immersing time into the treatment solution is preferably in the range of 5 to 600 seconds and more preferably in the range of 20 to 120 seconds. In this connection, the zinc or zinc alloy plating may be immersed into a dilute nitric acid solution in order to activate the surface of the zinc or zinc alloy plating, before the trivalent chromium chemical conversion treatment. The conditions and treatment operations other than those described above may be determined or selected in accordance with the conventional hexavalent chromium treatment method. In addition, the corrosion resistance of the black trivalent chromium chemical conversion coating film can be improve by the annealing treatment thereof. Especially, this corrosion resistance improvement is very high in a zinc-nickel alloy plating. The conditions of the annealing treatment are preferably at 100 to 250° C. for 10 to 300 mins. And more preferably at 150 to 200° C. for 10 to 300 mins.

In addition, to apply a water soluble finishing treatment containing trivalent chromium to the black trivalent chromium chemical conversion coating film according to the present invention is an effective post-processing method which can further improve a black appearance and corrosion resistance. Such a finishing treatment solution includes ZTB-118 available from Dipsol Chemicals Co., Ltd.

EXAMPLES

Examples 1 to 3

A steel plate, which had been plated with zinc in a thickness of 8 μm using a cyanide bath (M-900Y available from Dipsol Chemicals Co., Ltd.), was immersed in a treatment solution as shown in Table 1.

Examples 4 and 5

A screw part, which had been plated with zinc in a thickness of 8 μm using an acidic chloride bath (EZ-988 available from Dipsol Chemicals Co., Ltd.), was immersed in a treatment solution as shown in Table 1.

Examples 6 and 7

A steel plate, which had been plated with zinc in a thickness of 8 μm using an alkaline zincate bath (NZ-98 available from Dipsol Chemicals Co., Ltd.), was immersed in a treatment solution as shown in Table 1.

Example 8

A steel plate, which had been plated with zinc-nickel (a content of Ni is 14%) in a thickness of 8 μl (using IZ-250 available from Dipsol Chemicals Co., Ltd.), was immersed in a treatment solution as shown in Table 1.

Comparative Examples 1 to 3

A steel plate, which had been plated with zinc in a thickness of 8 μm using a cyanide bath (M-900Y available from Dipsol Chemicals Co., Ltd.), was immersed in a treatment solution as shown in Table 2.

Comparative Examples 4 and 5

A screw part, which had been plated with zinc in a thickness of 8 μm using an acidic chloride bath (EZ-988 available from Dipsol Chemicals Co., Ltd.), was immersed in a treatment solution as shown in Table 2.

Comparative Examples 6 and 7

A steel plate, which had been plated with zinc in a thickness of 8 μm using an alkaline zincate bath (NZ-98 available from Dipsol Chemicals Co., Ltd.), was immersed in a treatment solution as shown in Table 2.

Comparative Example 8

A steel plate, which had been plated with zinc-nickel (a content of Ni is 14%) in a thickness of 8 μm (using IZ-250 available from Dipsol Chemicals Co., Ltd.), was immersed in a treatment solution as shown in Table 2.

The steps of the chemical conversion treatment are as follows:

Plating with zinc or zinc-nickel→Water Washing→Activation with Nitric Acid→Water Washing→Trivalent Chromium Treatment→Water Washing→Finishing Treatment[1]→Drying[2]

Note 1: Using 150 ml/L of ZTB-118 available from Dipsol Chemicals Co., Ltd., 50□ and 10 sec.

Note 2: 80□ and 20 mins.

TABLE 1

| | Examples | | | | | | | |
|---|---|---|---|---|---|---|---|---|
| | 1 | 2 | 3 | 4 | 5 | 6 | 7 | 8 |
| $Cr^{3+}$ (g/L) | 5.0 | 2.5 | 10.0 | 2.5 | 5.0 | 5.0 | 4.0 | 5.0 |
| $NO_3^-$ (g/L) | 3.2 | 2.5 | 3.2 | 1.6 | 1.6 | 2.5 | 0.5 | 2.5 |
| $PO_4^{3-}$ (g/L) | 15 | 7.0 | 20 | 7.0 | 15 | 15 | 4.0 | |
| $Cl^-$ (g/L) | 15 | 7.0 | 30 | 10 | 15 | 15 | 12 | 20 |
| Oxalic acid (g/L) | 18 | 5.0 | 15 | | 18 | 18 | 12.6 | 15 |
| Malonic acid (g/L) | | 5.0 | 2.5 | 10 | | | | |
| $Co^{2+}$ (g/L) | 5 | | 3.0 | 2.5 | 5.0 | 4.0 | 1.5 | 5.0 |
| $Ni^{2+}$ (g/L) | | 2.5 | | 2.5 | | 1.0 | 1.5 | |
| $Fe^{2+}$ (g/L) | | 1.0 | 1.0 | | | | | |
| Formic acid (g/L) | 5.0 | 3.0 | 7.5 | 2.5 | 5.0 | 9.0 | 6.0 | 15 |
| pH of treatment solution | 1.6 | 1.8 | 2.0 | 2.3 | 1.9 | 1.7 | 2.1 | 1.8 |
| Treatment temperature (° C.) | 35 | 25 | 30 | 30 | 25 | 30 | 35 | 25 |
| Treatment time (sec) | 30 | 40 | 25 | 60 | 20 | 30 | 40 | 45 |

TABLE 2

| | Comparative Examples | | | | | | | |
|---|---|---|---|---|---|---|---|---|
| | 1 | 2 | 3 | 4 | 5 | 6 | 7 | 8 |
| $Cr^{3+}$ (g/L) | 5.0 | 2.5 | 10.0 | 2.5 | 5.0 | 5.0 | 4.0 | 5.0 |
| $NO_3^-$ (g/L) | 3.2 | 2.5 | 3.2 | 1.6 | 1.6 | 2.5 | 0.5 | 2.5 |
| $PO_4^{3-}$ (g/L) | 15 | 7.0 | 20 | 7.0 | 15 | 15 | 4.0 | |
| $Cl^-$ ( g/L) | 15 | 7.0 | 30 | 10 | 15 | 15 | 12 | 20 |
| Oxalic acid (g/L) | 18 | 5.0 | 15 | | 18 | 18 | 12.6 | 15 |

TABLE 2-continued

| | Comparative Examples | | | | | | | |
|---|---|---|---|---|---|---|---|---|
| | 1 | 2 | 3 | 4 | 5 | 6 | 7 | 8 |
| Malonic acid (g/L) | | 5.0 | 2.5 | 10 | | | | |
| $Co^{2+}$ (g/L) | 5 | | 3.0 | 2.5 | 5.0 | 4.0 | 1.5 | 5.0 |
| $Ni^{2+}$ (g/L) | | 2.5 | | 2.5 | | 1.0 | 1.5 | |
| $Fe^{2+}$ (g/L) | | 1.0 | 1.0 | | | | | |
| Formic acid (g/L) | — | — | — | — | — | — | — | — |
| pH of treatment solution | 1.6 | 1.8 | 2.0 | 2.3 | 1.9 | 1.7 | 2.1 | 1.8 |
| Treatment temperature (□) | 35 | 25 | 30 | 30 | 25 | 30 | 35 | 25 |
| Treatment time (sec) | 30 | 40 | 25 | 60 | 20 | 30 | 40 | 45 |

The appearance and salt spray test (JIS-Z-2371) of the zinc and zinc-nickel plating obtained in Examples 1 to 8 and Comparative Examples 1 to 8 are summarized in Table 3.

As shown in Table 3, the coating film obtained in Examples 1 to 8 has a uniform and good black and burnished appearance compared to those of Comparative Examples 1 to 8, and the same corrosion resistance as or more than those of Comparative Examples 1 to 8.

TABLE 3

| | Appearance of trivalent chromium chemical conversion coating film | Corrosion Resistance Time required for the formation of white rust (5% by mass) (hr.) |
|---|---|---|
| Example 1 | Black | 168 |
| Example 2 | Black | 120 |
| Example 3 | Black | 168 |
| Example 4 | Black | 144 |
| Example 5 | Black | 192 |
| Example 6 | Black | 216 |
| Example 7 | Black | 240 |
| Example 8 | Black | 480 |
| Comparative Example 1 | Interference color | 144 |
| Comparative Example 2 | Interference color | 120 |
| Comparative Example 3 | Interference color | 144 |
| Comparative Example 4 | Interference color | 144 |
| Comparative Example 5 | Interference color | 144 |
| Comparative Example 6 | Interference color | 192 |
| Comparative Example 7 | Interference color | 240 |
| Comparative Example 8 | Interference color | 512 |

The invention claimed is:

1. A treatment solution for forming a black hexavalent chromium-free chemical conversion coating film on zinc or zinc alloy, the solution comprising:

a trivalent chromium ion;

a chelating agent capable of forming a water soluble complex with the trivalent chromium ion;

one or more metal ions selected from the group consisting of cobalt ion, nickel ion and iron ion;

formic acid or a salt thereof used as a buffer in a hydrogen-ion concentration; and one or more inorganic acid ions selected from the group consisting of a phosphate ion, chlorine ion, nitrate ion and sulfate ion, wherein the content of the trivalent chromium ion is in the range of 0.5 to 15 g/L, the content of the chelating agent is in the range of 1 to 40 g/L, the content of the formic acid or salt thereof is in the range of 1 to 20 g/L and the content of the inorganic acid ions is in the range of 5 to 80 g/L.

2. The treatment solution according to claim 1, wherein the chelating agent is one or more members selected from the group consisting of monocarboxylic acid (except formic acid), dicarboxylic acid, tricarboxylic acid, hydroxycarboxylic acid, aminocarboxylic acid and salts thereof.

3. The treatment solution according to claim 1, wherein the hydrogen-ion concentration (pH) is in the range of 0.5 to 4.

4. The treatment solution according to claim 1, wherein the zinc alloy is a zinc-nickel alloy.

5. A method for chemical conversion treating, comprising the step of chemical conversion treating zinc or zinc alloy with the treatment solution according to claim 1 to form a black hexavalent chromium-free chemical conversion coating film on the zinc or zinc alloy wherein a temperature of the treatment solution is in the range of 10 to 50° C.

6. A method for chemical conversion treating, comprising the step of annealing treating a black hexavalent chromium-free chemical conversion coating film formed on zinc or zinc alloy by chemical conversion treating the zinc or zinc alloy with the treatment solution according to claim 1 at 100 to 250° C. for 10 to 300 mins.

7. A metal coated by zinc or zinc alloy and having a black hexavalent chromium-free chemical conversion coating film formed by chemical conversion treating with the treatment solution according to claim 1 on the zinc or zinc alloy.

* * * * *